US009869322B2

(12) United States Patent
Tanner et al.

(10) Patent No.: US 9,869,322 B2
(45) Date of Patent: Jan. 16, 2018

(54) METAL BELLOWS SEAL SECTION AND METHOD TO EVACUATE AIR DURING FILLING

(71) Applicant: Baker Hughes Incorporated, Houston, TX (US)

(72) Inventors: David Tanner, Broken Arrow, OK (US); Aron M. Meyer, Pryor, OK (US); Ryan P. Semple, Owasso, OK (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 330 days.

(21) Appl. No.: 14/682,569

(22) Filed: Apr. 9, 2015

(65) Prior Publication Data

US 2015/0330400 A1 Nov. 19, 2015

Related U.S. Application Data

(60) Provisional application No. 61/994,538, filed on May 16, 2014.

(51) Int. Cl.

| | |
|---|---|
| ***F04D 29/10*** | (2006.01) |
| ***F04D 29/06*** | (2006.01) |
| ***F04D 13/06*** | (2006.01) |
| ***F04D 1/00*** | (2006.01) |
| ***F04D 7/02*** | (2006.01) |
| ***F04D 13/10*** | (2006.01) |
| *F04D 13/08* | (2006.01) |

(52) U.S. Cl.
CPC ..... *F04D 29/108* (2013.01); *F04D 1/00* (2013.01); *F04D 7/02* (2013.01); *F04D 13/06* (2013.01); *F04D 13/10* (2013.01); *F04D 13/086* (2013.01); *F04D 29/106* (2013.01)

(58) Field of Classification Search
None
See application file for complete search history.

(56) References Cited

U.S. PATENT DOCUMENTS 4,421,999 A * 12/1983 Beavers ..... F04D 13/10 310/87
4,436,488 A * 3/1984 Witten ..... F04B 47/06 310/87

(Continued)

*Primary Examiner* — Peter J Bertheaud
*Assistant Examiner* — Geoffrey Lee
(74) *Attorney, Agent, or Firm* — Bracewell LLP; James E. Bradley

(57) ABSTRACT

An electrical submersible pump assembly has a seal section coupled to a motor that drives the pump. The seal section has first and second end members spaced axially apart from each other. An outer bellows has a fixed end mourned to the first end member and a floating end that moves axially relative to the fixed end. A rigid, tubular interconnect member has an inner end within the outer bellows and an cuter end fixed to the floating end of the outer bellows. An inner bellows has a floating end secured to the inner end of the interconnect member and a fixed end secured to the second end member. An interconnect evacuation passage extends axially through a side wall of the interconnect member. A first end member evacuation passage extends through the first end member and registers with the interconnect evacuation passage while the outer bellows is contracted.

19 Claims, 3 Drawing Sheets

(56) References Cited

U.S. PATENT DOCUMENTS 4,524,793 A * 6/1985 Silverwater ..... F15B 21/044 137/183
4,583,923 A * 4/1986 James ..... F04B 47/06 310/87
4,966,532 A * 10/1990 Fengsheng ..... F04D 29/108 277/409
4,992,689 A * 2/1991 Bookout ..... F04D 13/10 310/87
5,622,222 A * 4/1997 Wilson ..... E21B 41/02 166/105.4
5,649,692 A * 7/1997 Gilsdorf ..... B60G 11/26 267/64.21
6,201,327 B1 * 3/2001 Rivas ..... F04D 13/062 310/87
6,379,127 B1 * 4/2002 Andrews ..... F04D 13/083 277/387
6,851,935 B2 * 2/2005 Merrill ..... F04D 13/083 277/336
7,165,610 B2 * 1/2007 Hopper ..... E21B 33/085 166/84.1
7,520,735 B2 * 4/2009 Merrill ..... F04D 13/083 310/87
7,530,391 B2 * 5/2009 Hall ..... E21B 43/128 166/105
7,654,315 B2 * 2/2010 Du ..... E21B 4/003 166/105
7,665,975 B2 * 2/2010 Parmeter ..... F04D 13/10 417/423.11
7,708,534 B2 * 5/2010 Parmeter ..... E21B 43/128 166/105
7,810,560 B2 * 10/2010 Lembcke ..... E21B 17/026 166/242.6
8,221,092 B2 * 7/2012 Chilcoat ..... E21B 43/129 417/422
8,430,649 B2 * 4/2013 Albers ..... E21B 43/128 310/87
8,932,034 B2 * 1/2015 McKinney ..... E21B 43/128 166/105
2002/0113435 A1 * 8/2002 McGrath ..... F16L 51/035 285/299
2005/0087343 A1 * 4/2005 Du ..... E21B 4/003 166/369
2006/0222529 A1 * 10/2006 Watson ..... F04D 13/021 417/414
2007/0224057 A1 * 9/2007 Swatek ..... F04D 13/10 417/414
2010/0101778 A1 * 4/2010 Lembcke ..... E21B 17/026 166/207
2011/0123374 A1 * 5/2011 Albers ..... E21B 43/128 417/414
2012/0263610 A1 * 10/2012 Tetzlaff ..... F04D 29/0476 417/410.1
2013/0004344 A1 * 1/2013 McKinney ..... E21B 43/128 417/366
2014/0037434 A1 * 2/2014 Eslinger ..... F04D 13/10 415/168.2
2016/0312785 A1 * 10/2016 Meyer ..... F04D 29/128

* cited by examiner

METAL BELLOWS SEAL SECTION AND METHOD TO EVACUATE AIR DURING FILLING

CROSS REFERENCE TO RELATED APPLICATION

This application claims priority to provisional application 61/994,538, filed May 16, 2014.

FIELD OF THE DISCLOSURE

This disclosure relates in general to submersible well pomp assemblies and in particular to a motor oil pressure equalizing seal section having a metal bellows with features to evacuate air from the bellows during filling.

BACKGROUND

Electrical submersible pump assemblies (ESP) are commonly used to pump hydrocarbon well fluid from wells. A common type of ESP has a centrifugal pump with a large number of pump stages, each stage having an impeller and a diffuser. An electrical motor rotates a shaft assembly that drives the impellers. The motor is filled with a dielectric lubricant. A seal section or pressure equalizer has a movable element, such as a bag or bellows, that equalizes the lubricant pressure with the hydrostatic pressure of the well fluid. The seal section is usually mounted between file motor and the pump, and the drive shaft assembly extends through the motor.

Seal sections with bellows may employ an outer bellows and an inner bellows which has an inner end recessed with the outer bellows. The seal section has upper and lower end members with a chamber between for receiving the inner and outer bellows. The enter bellows has one fixed end secured to one of the end members; the inner bellows has one fixed end secured to the other of the end members. Each of the inner and outer bellows has a floating end that moves as the bellows extends and contracts. An interconnect member secures the floating ends of the inner and outer bellows to each other. The interconnect member is cup-shaped, having a side wall located within the interior of the outer bellows.

During filling of the seal section with lubricant, ideally substantially all of the air within the inner and outer bellows is evacuated by a vacuum pump before the lubricant is introduced. A vacuum may be applied to an evacuation passage in the lower end member, which causes the outer bellows to contract and the inner bellows to extend. As the enter bellows contracts, the lower end of the interconnect member will eventually abut the lower end member, which stops further contraction of the outer bellows. At this point, there will still be some air located in the annulus between the interconnect member and the outer bellows. Eliminating this trapped air can be difficult.

SUMMARY

An electrical submersible pump assembly includes a pump, a motor opera lively coupled to the pump for driving the pump, and a seal section having a longitudinal axis and coupled to the motor. The seal section has axially spaced apart first and second end members. A bellows has a fixed end mounted to the first end member and a floating end that moves axially as the bellows moves between an extended and a contracted position. A rigid sleeve is located within the bellows, defining a sleeve annulus between the sleeve and the bellows. The sleeve has an outer end that joins and moves axially with the floating end of the bellows. A sleeve evacuation passage in the side wall of the sleeve extends from the inner end of the sleeve to the sleeve annulus adjacent the outer end of the sleeve. A first member evacuation passage extends through the first end member to evacuate air from an interior of the bellows and from the sleeve evacuation passage prior to filling with lubricant.

The first member evacuation passage is in direct communication with an interior of the bellows inside of the sleeve as well as in direct communication with the sleeve annulus via the sleeve evacuation passage while the bellows is extended past a selected intermediate contracted position.

A seal means directly communicates the first member evacuation passage with air in an interior of the bellows inside of the sleeve as well as directly communicating the first member evacuation passage with air in the sleeve annulus via the sleeve evacuation passage while the bellows is extended past a selected intermediate contracted position. The seal means directly communicates the first member evacuation passage with air in the interior of the bellows inside of the sleeve only via the sleeve-evacuation passage after reaching the selected intermediate contraction point.

In the preferred embodiment, an axially protruding tube mounted in one of the evacuation passages has an open tip axially spaced from the other of the evacuation passages while the bellows is in the extended position. The open tip of the tube sealingly engages the other of the evacuation passages when an intermediate contracted position is reached. In the embodiment shown, the tube is mounted in the first member evacuation passage.

In the embodiment shown, the bellows comprises an outer bellows. The sleeve comprises an interconnect member with an inner end located within the outer bellows and an outer end secured to the outer bellows. An inner bellows has an inner end secured to the inner end of the interconnect member.

BRIEF DESCRIPTION OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not in be considered limiting of its scope as the disclosure may admit to other equally effective embodiments.

DETAILED DESCRIPTION OF THE DISCLOSURE

Figure 1:
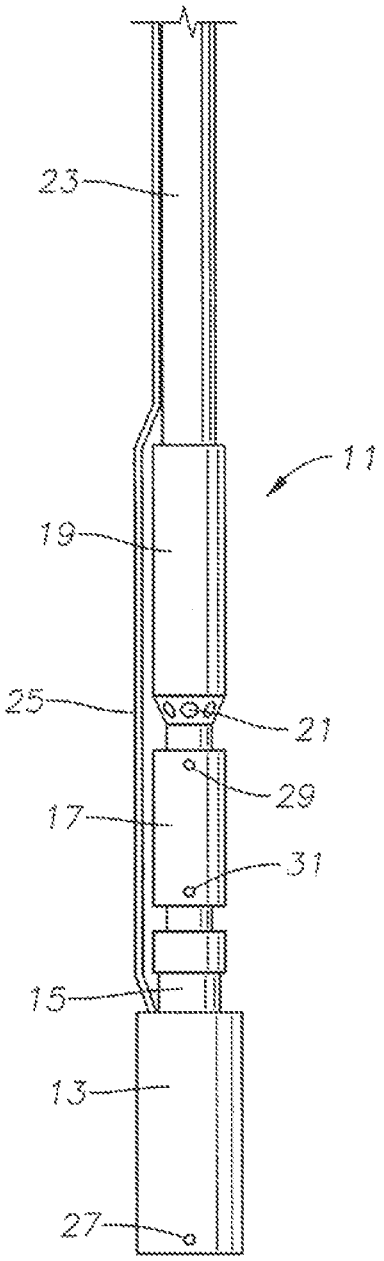
FIG. 1 is a side view of an electrical submersible pump assembly in accordance with this disclosure.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, an electrical submersible pomp (ESP) 11 typically includes an electrical motor 13. Motor 13 is normally a three-phase AC motor and may be connected in tandem to other motors. A thrust bearing unit 15 is illustrated at or within an upper end of motor 13. The terms "upper" and "lower" are used only for convenience and not in a limiting manner. A pressure equalizer or seal section 17 is shown connected to an upper end of thrust hearing unit 15. One or more thrust bearings may also be incorporated into seal section 17. Seal section 17 has features to reduce a pressure differential between a dielectric motor lubricant in motor 13 and the exterior well fluid hydrostatic pressure. Seal section 17 could alternately be located below motor 13.

A rotary pump 19 connects to the upper end of seal section 17 in this example. Pump 19 could be a centrifugal pump having a large number of stages, each stage having an impeller and a diffuser. Alternately, pump 19 could be another type, snob as a progressing cavity pump. A string of production tubing 23 secures to the upper end of pump 19 and supports ESP 11 in a well. Production tubing 23 may be sections ox tubing with threaded ends secured together, or it could be continuous coiled tubing. Pump 19 has an intake 21 for drawing in well fluid, which is discharged into production tubing 23. A power cable 25 extends downward alongside production tubing 23 from a wellhead (not shown) to motor 13 for supplying power to motor 13.

Motor 13 has a lubricant fill port 27, normally at its lower end, for filling motor 13 with lubricant before lowering ESP 11 into a well. Seal section 17 has a port 29 adjacent its upper end to expel trapped air during filling. Seal section 17 also has a lower port 31 to reduce trapped air.

Figure 2:
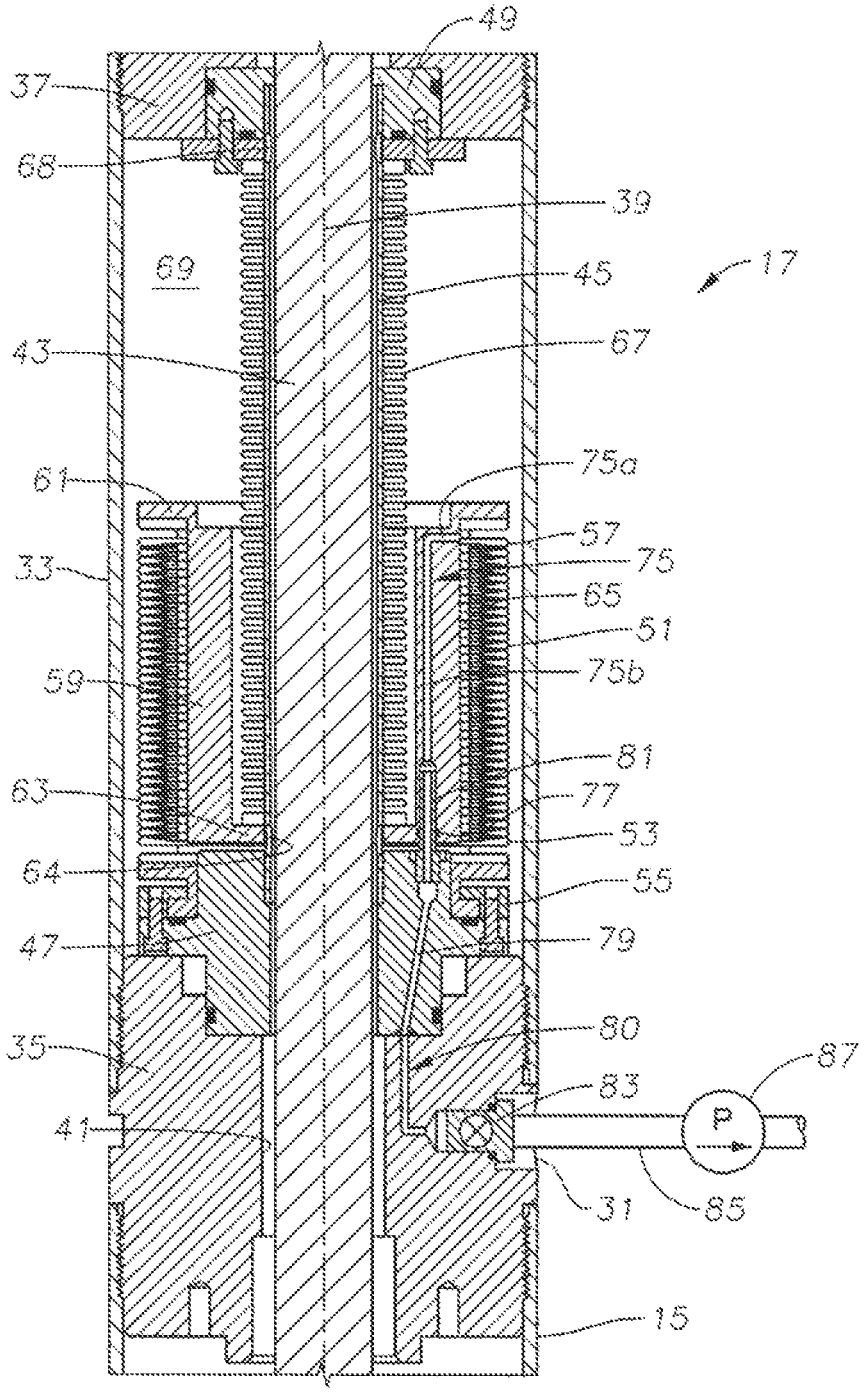
FIG. 2 is a sectional view of the seal section of the pump assembly of FIG. 1, shown with the bellows evacuated for filling with motor lubricant.

Referring to FIG. 2, seal section 17 has a cylindrical housing 33. A lower adapter 35 secures, such as by threads, to the lower end of housing 33. An upper adapter 37 secures, such as by threads, to an upper end of housing 33. Lower and upper adapters 35, 37 are spaced axially apart from each other along longitudinal axis 39. Lower adapter 35 has a bore 41 through which a drive shaft 43 extends. Drive shaft 43 extends from motor 13 (FIG. 1) through a bore in upper adapter 37 into engagement with pump 19 (FIG. 1) for driving the pump. Drive shaft 43 is typically in several sections connected by splined ends. Bushings are located in lower adapter 35 and upper adapter 37 for providing radial support to drive shaft 43. Note that if seal section 17 is mounted below motor 13, which is an alternative, drive shaft 43 would not extend through it. In this example, lower adapter 35 secures to thrust bearing unit 15, but it could alternately secure to mother seal section in tandem. Upper adapter 37 secures to the lower end of pump intake 21 and will have a mechanical face seal (not shown) for sealing around shaft 43.

A guide tube 45 surrounds shall 43 but is not in sliding contact with shaft 43. Guide tube 43 is supported at its lower end by a lower cap 47, which mounts to lower adapter 35. Lower cap 47 and lower adapter 35 may be considered to be a lower or first end member of seal section 17. Guide tube 43 is supported at its upper end by an upper cap 49, which mounts to a lower end of upper adapter 37 within a recess. Upper cap 49 and upper adapter 37 may be considered to be an upper or second end member of seal section 17.

In this embodiment, seal section 17 has a metal, outer bellows 51 with an outer diameter only slightly smaller than the inner diameter of housing 33. Outer bellows 51 has a fixed or lower end 53 that is secured by a retainer 55 to lower cap 47. Outer bellows 51 has a floating or upper end 57 spaced axially above lower end 53. Outer bellows 51 is cylindrical and has a corrugated, flexible sidewall.

Figure 3:
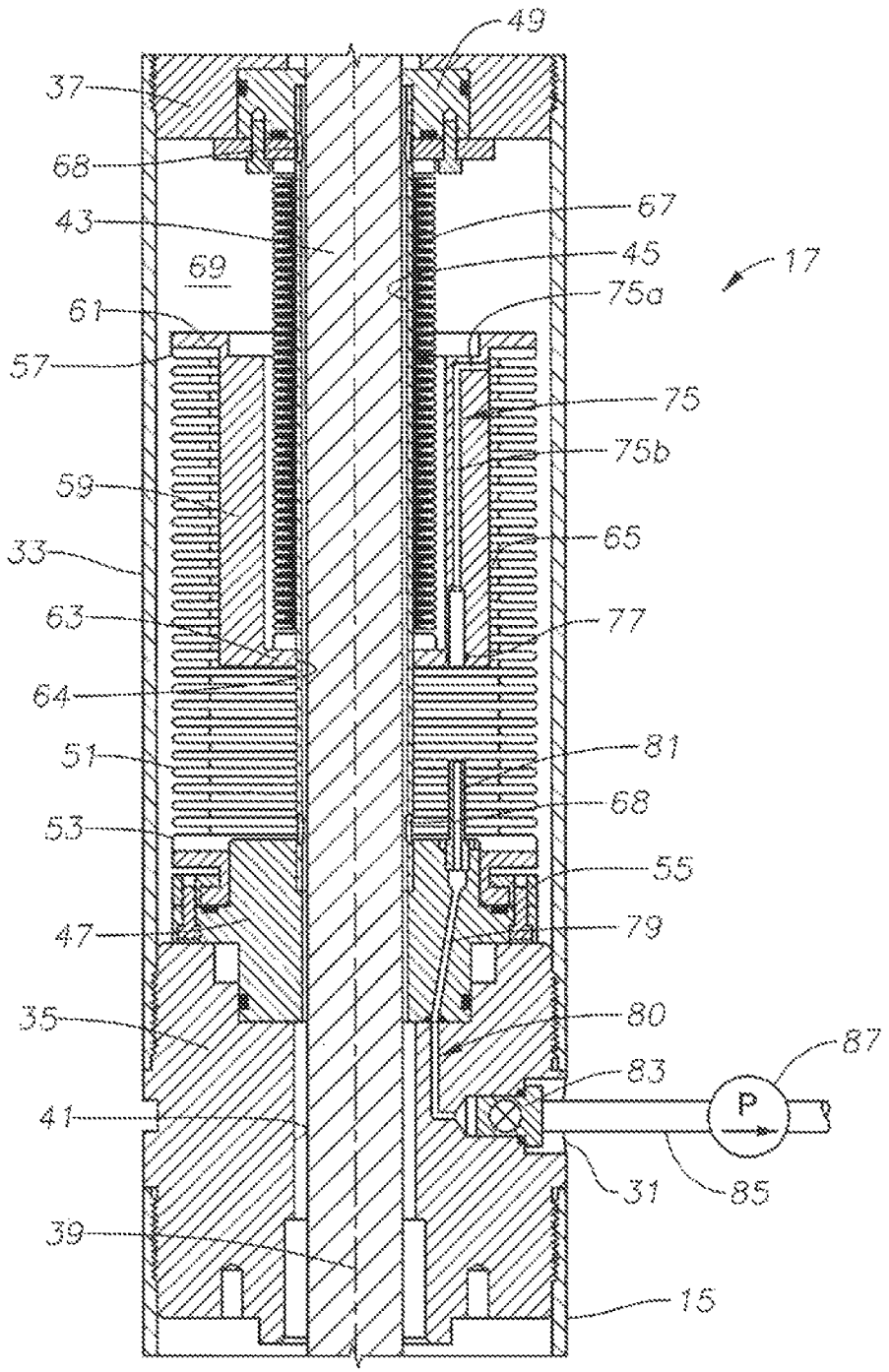
FIG. 3 is a sectional view of the seal section of FIG. 2, shown in a partially extended position after filling.

A cup-shaped interconnect member 59 fits within outer bellows 51. Interconnect 59 is a sleeve with an upper end 61 having an external flange that overlies and secures sealingly to outer bellows upper end 57. Interconnect 59 has a lower end 63 with an internal flange having a central opening 64 slightly larger in diameter than guide tube 45. Interconnect 59 has an outer diameter that is smaller than the inner diameter of outer bellows 51, defining a sleeve annulus 65 between interconnect 59 and outer bellows 51. Interconnect 59 moves up and down with outer bellows upper end 57 as outer bellows 51 moves between a contracted position shown in FIG. 2 and an extended position, such as shown in FIG. 3.

A metal, inner bellows 67 has a lower end within outer bellows 51. The lower end of inner bellows 67 secures and seals to lower end 63 of interconnect 59. Inner bellows 67 has an upper end that secures and seals to upper cap 49 in this embodiment. Alternately, inner bellows 67 could be fixed to lower cap 47 end have a floating upper end that floats with the upper end of outer bellows 51. Inner bellows 67 is cylindrical, corrugated, and has a smaller outer diameter than the inner wad of outer bellows 51. The inner diameter of inner bellows 67 is slightly larger than the outer diameter of guide tube 45. One or more ports 68 (four shown) communicate motor lubricant within guide tube 45 to the interior of inner bellows 67 and the interior of outer bellows 51, which are in fluid communication with each other.

A well fluid chamber 69 in housing 33 surrounds outer bellows 51 and inner bellows 67. A port (not shown) in upper adapter 37 admits well fluid to well fluid chamber 69. The main lubricant communication path from motor 13 (FIG. 1) to upper port 29 (FIG. 1) is through guide tube 45 as the upper end of guide tube 45 is not closed off. The interiors of guide tube 45, outer bellows 51, and inner bellows 67 define a lubricant chamber 73 in fluid communication with the motor lubricant in motor 13 (FIG. 1). Lubricant chamber 73 equalizes pressure with the hydrostatic well pressure in well fluid chamber 69.

In this disclosure, a sleeve air evacuation passage 75 is formed in interconnect 59 to evacuate any trapped air in sleeve annulus 65 prior to filling with lubricant. Sleeve evacuation passage 75 has a radial portion **75*a* leading to the exterior of interconnect 59 just below sleeve upper end 61. Radial portion 75*a* thus is located at the upper end of sleeve annulus 65. Sleeve evacuation passage 75 has an axial portion 75*b* that joins radial portion 75*a* and extends axially downward through the side wall of interconnect 59 to sleeve lower end 63. Axial portion 75*b* is open at its lower end and may have a seal ring 77. Sleeve evacuation passage 75 is isolated from the inner diameter of interconnect member 59**, which is exposed to well fluid during operation.

A lower cap air evacuation passage 79 extends from an upper end to a lower end of lower cap 47 and registers with sleeve evacuation passage 75 when outer bellows 51 is in an intermediate contracted position, which is between the fully contracted position of FIG. 2 and the partially extended position of FIG. 3. A lower adapter air evacuation passage 80 extends downward through lower adapter 35 to seal section lower port 31. The upper end of lower adapter evacuation passage 80 registers with the lower end of lower cap evacuation passage 79. Lower cap evacuation passage 79 and lower adapter evacuation passage 80 may be considered to comprise a lower or first end member evacuation passage.

A tube 81 has a lower end secured to the upper end of lower cap evacuation passage 79 and protrudes upward from the upper end of lower cap 47. When outer bellows 51 is fully contracted, as shown in FIG. 2, tube 81 extends into sleeve evacuation passage 75 and engages seal 77 to seal the interior of tube 81 to sleeve evacuation passage 75. When outer bellows 51 is fully contracted, interconnect lower end 63 abuts the upper cud of lower cap 47. When outer bellows 51 is fully extended (not shown), sleeve upper end 61 abuts upper adapter 37. FIG. 3 shows outer bellows 51 in a partially extended position. While fully contracted, in this example, tube 81 extends into sleeve evacuation passage 75 less than one-fourth the length of sleeve evacuation passage axial portion 75*b*. The length of tube 81 may vary, but is shown to be less than 20% of the distance from lower cap 47 to upper cap 49. Consequently, as interconnect 59 rises during lubricant filling, tube 81 will disengage from sleeve evacuation passage 75.

Alternately, tube 81 could be extensible in length or telescoping so as to always be in engagement with sleeve evacuation passage 75. Also, in an another alternate embodiment, tube 81 could be fixed in the lower end of sleeve evacuation passage 75 and point downward to engage lower cap member evacuation passage 79 when outer bellows 51 contracts.

Lower adapter evacuation passage 79 leads downward to seal section lower port 31. A valve 83 controls flow through lower port 31. A hose 85 is schematically illustrated as being connected between lower port 31 and a vacuum pump 87.

During one example of a filling operation, motor 13 is normally filled with lubricant first with a vacuum filling process and employing motor fill port 27. Seal section 17 is then coupled to the upper end of motor 13, which includes thrust bearing unit 15, in this example. This subassembly will normally be suspended vertically. A vacuum is applied to the interiors of outer bellows 51 and inner bellows 67. Outer bellows 51 may be in a partially extended position, as shown in FIG. 3, as the vacuum process begins. The vacuum draws air directly from the interiors of bellows 51 and 67 as well as from sleeve evacuation passage 75. The vacuum may be applied by a vacuum pump (not shown) through seal section upper port 29 (FIG. 1) as well as by vacuum pump 87 at seal section lower port 31. The vacuum at upper port 29 draws air from the annulus between shall 43 and guide tube 45 as well as air from the interiors of inner bellows 67 and interiors of outer bellows 51 via ports 68. The vacuum at lower port 31 draws air directly from the interiors of inner bellows 67 and outer bellows via the open upper end of tube 81.

As outer bellows 51 contracts to a selected intermediate position before reaching the fully contracted position, tube 81 sealingly engages sleeve evacuation passage 75. Then vacuum pump 87 at lower port 31 evacuates air from sleeve annulus 65 and the interior of inner bellows 67 only via interconnect evacuation passage 75. At this point all of the air being evacuated from bellows 51, 67 via tube 81 must flow through sleeve evacuation passage 75 because of seal 77. The evacuation through seal section lower port 31 removes more trapped air in sleeve annulus 65 than evacuating only through seal section upper port 29.

The operator then pumps lubricant in fill motor port 27 (FIG. 1), which rises through motor 13 and thrust bearing unit 15 into seal section 17. The vacuum at seal section lower and upper ports 31, 29 may continue as the lubricant is introduced. The lubricant flows upward through bore 41 and guide tube 45 out ports 68 into the interiors of outer bellows 51 and inner bellows 67. The lubricant causes outer bellows 51 to extend and inner bellows 67 to contract, as shown in FIG. 3. Once tube 81 disengages from sleeve evacuation passage 75, lubricant is free to flow down evacuation passages 79, 80, thus valve 83 may be closed. Once lubricant reaches seal section upper port 29, the vacuum at upper port 29 would be relieved and the pumping of lubricant stopped.

While the disclosure has been shown and described in only a few of its forms, it should be apparent to those skilled in the art that changes may be made. For example, the vacuum could optionally be applied only to the lower seal section port, and not the upper seal section port. The seal section could be inverted from the position shown.

The invention claimed is:

1. An electrical submersible pump assembly, comprising:

a pump;

a motor operatively coupled to the pump for driving the pump;

a seal section having a longitudinal axis and coupled to the motor, the seal section comprising:

axially spaced apart first and second end members;

a bellows having a fixed end mounted to the first end member and a floating end that moves axially as the bellows moves between an extended and a contracted position;

a rigid sleeve located within the bellows, defining a sleeve annulus between the sleeve and the bellows, the sleeve having an outer end that joins and moves axially with the floating end of the bellows, the sleeve annulus having a closed outer end and an open inner end;

a sleeve evacuation passage within the side wall of the sleeve extending from a sleeve evacuation passage port in the inner end of the sleeve to a sleeve evacuation passage opening in the sleeve annulus adjacent the outer end of the sleeve;

a first member evacuation passage from an exterior of the first end member through the first end member to a first member evacuation passage non facing the inner end of the sleeve to evacuate air from an interior of the bellows and from the sleeve evacuation passage prior to filling with lubricant;

a first flow path for air evacuation from the open inner end of the sleeve annulus to the first member evacuation passage port;

a second flow path for air evacuation from the sleeve evacuation passage opening through the sleeve evacuation passage and out the sleeve evacuation passage port to the first member evacuation passage port; and means for evacuating air from both the first and second flow paths while the bellows is in an extended position and for evacuating air from only the second flow path when the bellows reaches a selected intermediate contracted position.

2. The assembly according to claim 1, wherein:

the sleeve has an interior side and an exterior side;

the sleeve evacuation passage opening is on the exterior side; and the sleeve evacuation passage port is isolated from the interior side.

3. The assembly according to claim 1, wherein:

the ports are in axial alignment with each other and offset from the axis.

4. The assembly according to claim 1, wherein the means for evacuating air comprises:

an axially protruding tube mounted in one of the ports and offset from the axis, the tube having an open tip axially spaced from the other of the ports while the bellows is in the extended position; and wherein the open tip of the tube sealingly engages the other of the ports when the selected intermediate contracted position is reached.

5. The assembly of claim 1, wherein the means for evacuating air comprises:

an axially protruding tube mounted in the first member evacuation passage port offset from the axis and having an open tip axially spaced from the sleeve evacuation passage port while the bellows is in the extended position; and wherein the open tip of the tube sealingly engages the sleeve evacuation passage port when the selected intermediate contracted position of the bellows is reached.

6. The assembly of claim 1, wherein:

the bellows comprises an outer bellows with a fixed end mounted to the first end member and a floating end that moves axially relative to the fixed end;

the sleeve comprises an interconnect member with an inner end located within the outer bellows and an outer end secured to the floating end of the outer bellows; and the assembly further comprises:

an inner bellows having an inner end secured to the inner end of the interconnect member; and wherein the sleeve evacuation passage is isolated from an exterior of the inner bellows.

7. An electrical submersible pump assembly, comprising:

a pump;

a motor operatively coupled to the pump for driving the pump;

a seal section having a longitudinal axis and coupled to the motor, comprising:

first and second end members spaced axially apart from each other, an outer bellows having a fixed end mounted to the first end member and a floating end that moves axially relative to the fixed end;

a rigid, tubular interconnect member having an inner end within the outer bellows and an outer end fixed to the floating end of the outer bellows, the interconnect member having a cylindrical side wall extending between the inner and outer ends of the interconnect member, concentric with the axis, defining an interconnect annulus between the side wall of the interconnect member and the outer bellows, the interconnect annulus having a closed outer end and an open inner end;

an inner bellows having a floating end secured to the inner end of the interconnect member and a fixed end secured to the second end member;

an interconnect evacuation passage extending axially within the side wall of the interconnect member and offset from the axis, the interconnect evacuation passage having an interconnect evacuation passage ort at the inner end of the interconnect member that is offset from the axis, the interconnect evacuation passage having an interconnect evacuation passage opening in the side wall of the interconnect member that opens to the interconnect annulus adjacent the floating end of the outer bellows;

a first end member evacuation passage extending from an exterior surface of the first end member to a first end member evacuation passage port on an end of the first end member that faces the inner end of the interconnect member, the first end member evacuation passage port being offset from the axis and aligned with the interconnect member evacuation passage port;

a tube offset from the axis, the tube joining and protruding axially from one of the ports toward the other of the ports;

the tube having an open tip that extends sealingly into the other of the ports while the outer bellows is in a contracted position and is disengaged from the other of the ports while the outer bellows is in an extended position; wherein the extended position defines a first flow path from the inner end of the interconnect annulus to the first end member evacuation passage and a second flow path through the interconnect member evacuation passage to the first end member evacuation passage to evacuate air from the inner and outer bellows prior to filling with motor lubricant; and the contracted position closes the first flow path and leaves the second flow path open.

8. The assembly of claim 7, further comprising:

a rotatable drive shaft extending through the first and second end members;

a guide sleeve concentric with the axis and surrounding the drive shaft, the guide sleeve extending between the first and second end members and having a guide sleeve opening in fluid communication with an interior of the inner bellows; and wherein the tube is located radially outward from the guide sleeve.

9. The assembly of claim 7, wherein:

the outer bellows has an intermediate contracted position between the contracted and the extended positions; and the up of the tube is in sealing engagement with the other of the ports while the outer bellows is in the intermediate contracted position.

10. The assembly of claim 7, wherein:

the tube joins and protrudes axially from the first end member evacuation passage port.

11. The assembly according to claim 7, wherein:

the interconnect member evacuation passage has an axial dimension from the interconnect member evacuation passage port to the interconnect evacuation pay opening; and the tube protrudes axially from said one of the ports a distance less than the axial dimension.

12. The assembly according to claim 7, wherein the interconnect evacuation passage comprises an axial portion parallel with and offset from the axis and a lateral portion extending from the axial portion to the interconnect evacuation passage opening.

13. The assembly according to claim 7, wherein:

an interior of the interconnect member is adapted to be in fluid communication with well fluid during operation of the assembly; and the interconnect evacuation passage is isolated from the interior of the interconnect member.

14. The assembly according to claim 7, wherein:

the outer bellows has a contracted axial length while in the contracted position; and the tube has an axial length protruding from said one of the ports that is less than the contracted axial length.

15. A method of filling a seal section of an electrical submersible pump assembly, the seal section having a longitudinal axis, axially spaced apart first and second end members, a bellows having a fixed end mounted to the first end member and a floating end that moves axially as the bellows extends and contracts, a rigid sleeve located within the bellows, defining a sleeve annulus between the sleeve and the bellows, the sleeve having an outer end that joins and moves axially with the floating end of the bellows, the sleeve annulus having a closed outer end and an open inner end, the method comprising steps:

(a) providing a sleeve evacuation passage within a side wall of the sleeve, the sleeve evacuation passage having an opening to the sleeve annulus adjacent the outer end of the sleeve, the sleeve evacuation passage having a sleeve evacuation passage port at the inner end of the sleeve;

(b) providing a first member evacuation passage from an exterior surface of the first end member through the first end member to a first member evacuation passage port;

(c) applying a vacuum to the first member evacuation passage and removing air from the interior of the bellows via a first flow path from the open inner end of the sleeve annulus to the first member evacuation passage port and also via a second flow path through the sleeve evacuation passage to the first member evacuation passage port, the removal of air causing the bellows to move from an extended position toward a contracted position; then (d) when the bellows reaches a selected intermediate contracted position, closing the first flow path and continuing to remove air along the second flow path; then (e) when the bellows reaches a desired fully contracted position, introducing lubricant into the bellows, causing the bellows to move toward the extended position and fill with the lubricant.

16. The method according to claim 15, wherein:

steps (a) and (b) comprise offsetting each of the ports from the axis.

17. The method according to claim 15, wherein:

step (d) comprises sealing the first member evacuation passage port to the sleeve evacuation passage port when the selected intermediate contracted position is reached.

18. The method according to claim 15, wherein:

steps (a) and (b) further comprise mounting a tube in the first member evacuation passage non protruding toward the sleeve evacuation passage port, the tube being parallel to and offset from the axis, the tube having an open tip axially spaced from the sleeve evacuation passage port while the bellows is in the extended position; and step (d) further comprises sealingly inserting the open tip of the tube into the sleeve evacuation passage port when the selected intermediate contracted position is reached.

19. The method according to claim 15, wherein:

steps (a) and (b) further comprise mounting an axially protruding tube in one of the ports the tube having an open tip axially spaced from the other of the ports while the bellows is in the extended position; and step (d) further comprises sealing the open tip of the tube in the other of the ports when the intermediate contracted position is reached.

* * * * *